US008814108B2

(12) United States Patent
Bernstein

(10) Patent No.: US 8,814,108 B2
(45) Date of Patent: Aug. 26, 2014

(54) PRODUCT DISPLAY SYSTEM

(76) Inventor: David Bernstein, Roswell, GA (US)

( * ) Notice: Subject to any disclaimer, the term of this patent is extended or adjusted under 35 U.S.C. 154(b) by 0 days.

(21) Appl. No.: 13/596,748

(22) Filed: Aug. 28, 2012

(65) Prior Publication Data

US 2014/0061401 A1 Mar. 6, 2014

(51) Int. Cl.

| | |
|---|---|
| ***A47F 5/00*** | (2006.01) |
| ***A47F 7/00*** | (2006.01) |
| ***F16M 11/00*** | (2006.01) |
| ***F16M 13/00*** | (2006.01) |
| *A47B 96/06* | (2006.01) |
| *A47G 29/00* | (2006.01) |
| *A47K 1/00* | (2006.01) |
| *E04G 3/00* | (2006.01) |
| *E04G 5/06* | (2006.01) |
| *F21V 21/00* | (2006.01) |
| *F21V 35/00* | (2006.01) |
| *A47B 96/00* | (2006.01) |
| *A47K 5/00* | (2006.01) |
| *G09F 7/18* | (2006.01) |
| *E05B 73/00* | (2006.01) |
| *A47F 5/08* | (2006.01) |

(52) U.S. Cl.

USPC ..... 248/125.3; 248/220.31; 248/220.41; 248/221.12; 248/222.41; 211/7; 211/107; 211/113; 211/117

(58) Field of Classification Search

USPC ..... 248/124.1, 220.21, 220.31, 220.41, 248/220.42, 235, 241, 912; 211/57.1, 59.1, 211/106.01, 117, 207, 7, 54, 1, 107, 113, 211/190–193

See application file for complete search history.

(56) References Cited

U.S. PATENT DOCUMENTS

| | | | | |
|---|---|---|---|---|
| 698,272 | A * | 4/1902 | Glover | 211/39 |
| 797,451 | A | 8/1905 | McBryde | |
| 1,698,974 | A * | 1/1929 | Vance | 211/60.1 |
| 2,872,144 | A | 2/1959 | Hobson | |
| 3,202,292 | A | 8/1965 | Deliso | |
| 3,512,654 | A | 5/1970 | Olsen et al. | |
| 3,698,566 | A * | 10/1972 | D'Altrui | 211/193 |
| 3,749,344 | A | 7/1973 | Racina | |
| 3,888,441 | A | 6/1975 | Rebentisch | |
| 4,138,019 | A | 2/1979 | Smith | |
| 5,086,935 | A | 2/1992 | Gallagher | |
| 5,547,088 | A | 8/1996 | Belokin et al. | |
| 5,657,884 | A | 8/1997 | Zilincar, III | |
| 5,957,422 | A | 9/1999 | Shea | |
| 6,070,747 | A | 6/2000 | Shea | |
| 6,083,051 | A | 7/2000 | Chang | |
| 6,202,866 | B1 | 3/2001 | Shea | |

(Continued)

*Primary Examiner* — Jonathan Liu
*Assistant Examiner* — Taylor Morris
(74) *Attorney, Agent, or Firm* — Marshall, Gerstein & Borun LLP

(57) ABSTRACT

A product display system includes a hanger support member and one or more product hangers. The hanger support member includes a web having opposite first and second sides. A plurality of receiving apertures extend through the web from the first side to the second side. Each product hanger includes body having an outboard side opposite an inboard side, a product support member extending from the outboard side of the body, and one or more brackets extending from the inboard side for mounting in the receiving apertures. The brackets and the receiving apertures are arranged such that one product hanger may be secured to the first side of the web and a second product hanger may be secured to the second side of the web, wherein the second product hanger is aligned directly opposite the first product hanger.

17 Claims, 3 Drawing Sheets

(56) References Cited

U.S. PATENT DOCUMENTS

| | | | | |
|---|---|---|---|---|
| D459,626 | S | 7/2002 | Shea | |
| D464,510 | S | 10/2002 | Shea | |
| D465,371 | S | 11/2002 | Shea | |
| 6,484,985 | B1 | 11/2002 | Heltzer | |
| D466,352 | S | 12/2002 | Shea | |
| 6,536,613 | B2 | 3/2003 | Shea | |
| 7,070,021 | B1 | 7/2006 | McKinney | |
| 7,118,000 | B2 | 10/2006 | Shea | |
| 7,121,416 | B2 | 10/2006 | Shea | |
| 7,182,232 | B2 | 2/2007 | Fleming et al. | |
| 7,331,473 | B2 | 2/2008 | Smith et al. | |
| 7,427,053 | B2 | 9/2008 | Nawrocki | |
| 7,513,374 | B2 | 4/2009 | Smith et al. | |
| 7,520,476 | B2 * | 4/2009 | Caveney et al. | 248/72 |
| 7,571,882 | B2 | 8/2009 | Walter | |
| 7,677,400 | B2 | 3/2010 | Bayazit et al. | |
| 7,690,607 | B2 | 4/2010 | Garmyn | |
| 7,712,616 | B2 | 5/2010 | Barkdoll | |
| 7,748,541 | B2 | 7/2010 | Smith et al. | |
| 8,087,521 | B2 | 1/2012 | Schwartzkopf et al. | |
| 8,127,941 | B2 | 3/2012 | Smith et al. | |
| 2010/0127141 | A1 | 5/2010 | Chan et al. | |

* cited by examiner

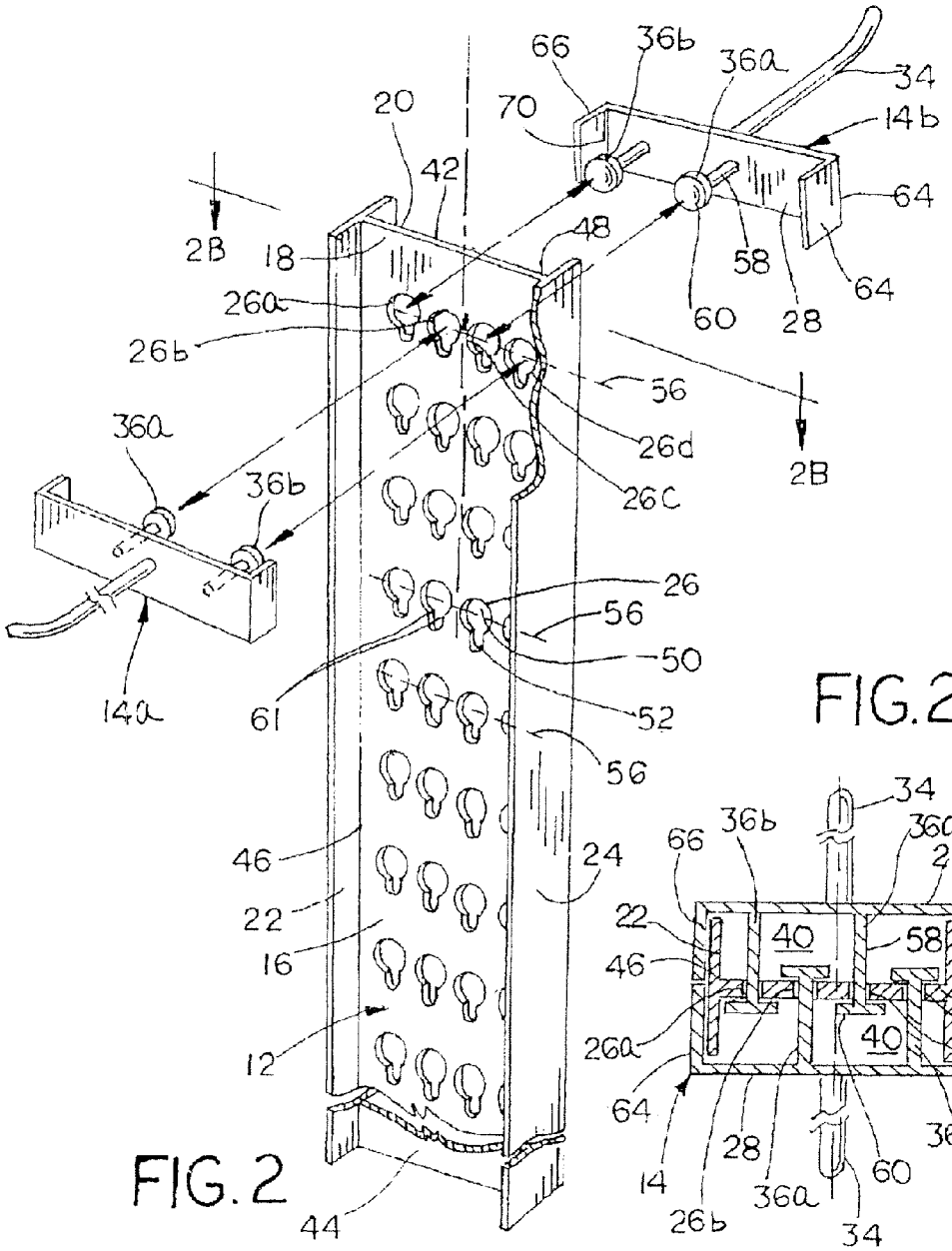
FIG. 2
FIG. 2A
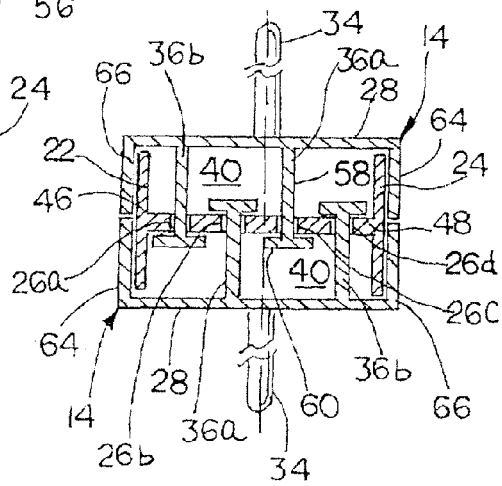

PRODUCT DISPLAY SYSTEM

BACKGROUND

1. Field of the Disclosure

The present disclosure relates generally to a product display system, such as for displaying merchandise at a retail location.

2. Description of the Background

Retail merchandise is displayed in many different ways at a retail outlet. For example, merchandise may be displayed on shelves or in racks. The method of displaying the merchandise is often selected in a manner to enhance some consumer perception, such as value, desirability, etc.

Some methods of displaying merchandise are intended to capitalize on the so called impulse purchase. Such methods generally include displaying a small number of relatively small sized product units in a location that is both immediately noticeable to the consumer and easily accessible. Sometimes these displays are placed in a location where a consumer is likely to have to wait for some period of time, such as at checkout counters. Sometimes such displays are located along the general flow of traffic of consumers through a store and prominently displayed in a manner that literally stands apart from the surrounding products. Such product displays often include a hanging vertical display assembly including an elongate vertical body with multiple product hangers extending from one or both sides of a vertical base strip, also frequently known as strip display assemblies.

Strip display assemblies come in many different forms. One common strip display assembly includes an upstanding or hanging, generally vertical support panel with a number of product hangers, such as hooks or clips, that extend from one side of the vertical panel. Products are hung from the product hangers and a consumer may easily remove one of the products from the strip display assembly by simply lifting it off the hook or removing it from the clip. Often these strip display assemblies are single-sided, meaning that the hooks are disposed on only one side of the support panel. Such single-sided strip display assemblies however may not maximize the available amount of display space because products can only be displayed on one side of the support panel.

In order to overcome the limitations of the single-sided strip display assembly, other strip display assemblies have been adapted to be two-sided, wherein product hangers are disposed on front and back sides of a generally vertical support panel, such that products may be displayed on both the front and back sides of the strip display assembly rather than on only one side of the support panel.

Strip display assemblies often include removable product hangers that may be assembled to hang from the support panel in any of the many different locations to provide a more versatile product display system that is adaptable for displaying products of different sizes and/or in different arrangements. One common type of product display system includes a pair of vertically oriented support panels disposed adjacent each other with a space or gap formed therebetween. Each support panel includes a plurality of apertures therethrough, and each display hanger includes one or more brackets or cleats that can be inserted into various ones of the apertures to releasably mount the product hanger to the support panel. The two support panels are spaced apart so that the distal ends of the brackets of one product hanger do not interfere with the distal ends of the brackets of another product hanger when the two product hangers are mounted on opposite sides of the support panels aligned directly opposite with each other. Some general examples of systems generally similar to this are disclosed in Shea, U.S. Pat. No. 5,957,422 and in Barkdoll, U.S. Pat. No. 7,712,616. Although versatile, this style of strip display assembly often requires some assembly in the field in order to dispose the two support panels in spaced apart relation.

Another type of strip display assembly dispenses with the need to assemble the two support panels in spaced apart relation by providing only a single support panel that is vertically oriented, for example by being hung from a hook. Display hangers are connected to the vertical panel with cleats that extend through apertures through the support panel. Display hangers can be hung on either or both of the front side and the back side of the support panel. Some general examples of systems generally similar to this are disclosed in Shea, U.S. Design Pat. No. D464,510 and Shae U.S. Pat. No. 6,536,613. However, in this arrangement it is not possible to hang two display hangers on both the front and back sides of the vertical panel such that the product hangers are directly opposite or aligned with each other vertically and horizontally. Rather, it is necessary in this type of strip display assembly for one product hanger on one side of the vertical panel to be displaced vertically and/or horizontally from the other product hanger on the other side of the vertical panel so that the cleats of the one product hanger do not interfere with the other product hanger. This effect can limit the versatility of this type of strip display assembly.

SUMMARY

In one aspect of the present disclosure, a product display system includes a hanger support member and one or more product hangers adapted to be mounted to the hanger support member with one or more cleats that fit through receiving apertures extending through the hanger support member. The product hangers and the hanger support member are arranged such that two product hangers may be mounted on opposite sides of the hanger support member and aligned with each other horizontally and vertically without requiring two vertical support panels with a space therebetween. Rather, when one product hanger is mounted to either side of the hanger support member, a space is formed between the hanger support member and the product hanger. The space is sized to receive a distal end of the mounting cleats from the other product hanger mounted on the other side of the hanger support member directly opposite the one product hanger. Further, the cleats on each product hanger may be arranged to engage a first set of the receiving apertures when mounted to one side of the hanger support member and a different, second set of the receiving apertures when mounted to the other side of the hanger support member.

According to one exemplary arrangement, the hanger support member includes a web that is generally vertically oriented and having opposite first and second sides. A plurality of receiving apertures extend through the web from the first side to the second side. Each product hanger includes a body having an outboard side opposite an inboard side, a product support member disposed on the outboard side, and one or more brackets extending from the inboard side to be mounted in the receiving apertures. The brackets and the receiving apertures are arranged such that a first product hanger may be mounted to the first side of the web with a bracket disposed through a first receiving aperture and a second product hanger may be mounted to the second side of the web with a bracket disposed through a second receiving aperture, wherein the second product hanger is directly opposite and/or aligned with the first product hanger, and a distal end of each bracket is disposed in a space between the web and the body of the opposite product hanger.

In further accordance with any one or more of the foregoing exemplary aspects and/or arrangements, a product display system and/or any one more component thereof optionally may include any one or more of the following further forms.

In some forms, one or more spacers are disposed on one or both sides of the web between the web and the respective body of each of the first and second product hangers and arranged to form the gap between the web and each body. Each gap is sized to receive the distal end of a bracket projecting through one of the receiving apertures between the web and the body. The spacers may be carried by or be part of the web. The spacers may be in the form of one or more spacer flanges carried by the web. The spacer flanges may be disposed along opposite lateral vertical edges of the web. The web and the spacer flanges may define an I-section, i.e., a cross-section shaped like the letter I.

In some forms, the receiving apertures may be arranged in horizontal rows across the web, each row spaced vertically from adjacent rows. One or more rows may be defined by two receiving apertures. One or more rows may be defined by four receiving apertures. One or more rows may be defined by two, four, or more than four apertures. The receiving apertures may be arranged in one or more quadrilateral arrays of four receiving apertures defining two rows, each row defined by two apertures. The quadrilateral array may form a rectangular array. The quadrilateral array may form a trapezoidal array. The quadrilateral array may have a height in the vertical direction and be spaced from a second adjacent quadrilateral array a distance equal to or different from the height.

In some forms, each receiving aperture has an upper section having a first width and a lower section having a second width, wherein the second width is less than the first width. The upper section may form a horizontal slot and the lower section may form a vertical slot. The upper section may have a first diameter. The lower section may have a second diameter. The receiving aperture may have a T-shape. The receiving aperture may have a keyhole shape.

In some forms, the brackets and the receiving apertures are arranged such that the product hangers may be releasably mounted to the hanger support member to allow easy removal from and re-arrangement on the hanger support member when desired.

In some forms the product hanger has two brackets. The brackets may be vertically and horizontally offset from each other along a diagonal. The brackets may be arranged to fit into two receiving apertures at opposite diagonal corners of the quadrilateral array. The brackets may be disposed at opposite diagonal regions of the body. The brackets may be disposed in a horizontal row across the body. The brackets may be laterally offset from a vertical centerline of the inboard board side of the body. The brackets may be arranged to fit into first and third of the receiving apertures in the same row from a first side of the web, the first and third receiving apertures disposed on opposite sides of the second aperture. The brackets may be arranged to fit into the second and fourth receiving apertures in the same row from the second side of the web, the second and fourth apertures disposed on opposite sides of the third aperture.

In some forms, each bracket may have a shaft extending from the body plate and a head that is wider than the shaft. The head may be disposed at the distal end of the shaft. The head may be sized to fit through the upper section of the receiving aperture and not through the lower section of the receiving aperture. The shaft may be sized to fit through the lower section of the receiving aperture. The shaft may be at least as long as the sum of a thickness of the web and the gap at the receiving aperture. The head may have an elongate horizontal shape that is complementary to a horizontal slot of the receiving aperture. The head may have a circular or arcuate shape with a radius that is complementary to a diameter of the upper section of the receiving aperture.

In some forms, one or more guide flanges may be carried by or be part of the product hanger. The guide flanges may be carried by the body. The guide flanges may be disposed on opposite lateral vertical edges of the body, each guide flange extending vertically along the respective vertical edge and having an inner face facing the opposite flange. The guide flanges may be spaced apart and arranged such that the guide flanges engage the spacer flanges. The spacer flanges may be disposed between the guide flanges. The inner face of each guide flange may engage an outer face of each spacer flange. The guide flanges may extend from the body a width of not more than one half the width of the spacer flanges.

In some forms, the product support member includes a hook extending from the outboard side. In some forms, the product support member may include a clip or other support structure arranged to support one or more pieces of merchandise.

In some forms, the body of the product hanger is in the form of a plate. The plate may be flat on one or both sides.

In some forms, the vertical support member includes a hanger and/or a hanger receiver for suspending the hanger support member. The hanger or hanger receiver may be disposed at a top end of the vertical support member.

In some forms, a top end of a first hanger support member may be connected to bottom end of a second hanger support member. The first and second hanger support members may be connected with a product hanger having a first bracket disposed in a receiving aperture in the first hanger support member and a second bracket disposed in a receiving aperture in the second hanger support member.

Other aspects and forms will become apparent upon consideration of the following detailed description.

BRIEF DESCRIPTION OF THE DRAWINGS

FIG. 2 is an exploded isometric view of another exemplary arrangement of a product display system according to the present disclosure;

FIG. 2A is a horizontal cross-sectional view of the product display assembly taken along the line 2A-2A of FIG. 2.

DETAILED DESCRIPTION

Figures 1, 1A:
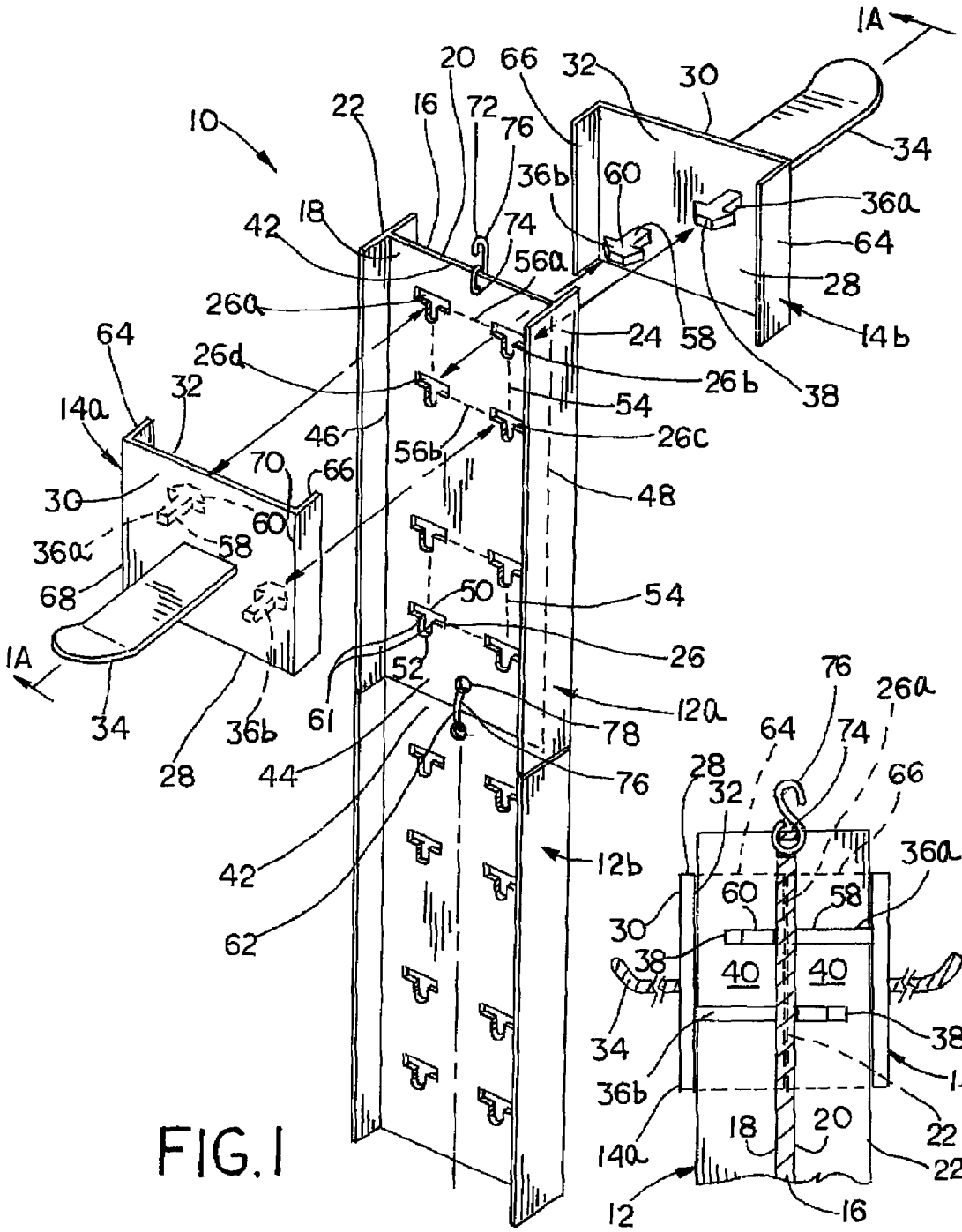
FIG. 1 is an exploded isometric view of one exemplary arrangement of a product display assembly in accordance with the present disclosure.
FIG. 1A is a vertical partial cross-sectional view of the product display assembly taken along the line 1A-1A of FIG. 1.

Turning now to the drawings, FIGS. 1 and 1A show an exemplary product display system 10 including one or more hanger support members 12, such as a first and second or upper and lower hanger support members 12*a* and 12*b*, and one or more product hangers 14, such as first and second product hangers 14*a* and 14*b*, arranged to be removably mounted to either or both of the hanger support members 12*a* and 12*b*. Preferably, the hanger support members 12*a*, 12*b* are substantially identical, and the product hangers 14*a*, 14*b* are substantially identical, and the letter designation "a," "b," etc. identify different units of the same basic component. Each hanger support member 12 includes a web 16 that is generally vertically oriented having opposite first and second sides 18, 20, a first spacer flange 22, a second spacer flange 24, and a plurality of receiving apertures 26, of which only four receiving apertures 26*a*-26*d* are specifically called out by individual references a-d for clarity sake. Each product hanger 14 includes a body 28 having an outboard side 30 opposite an inboard side 32, a product support member 34 extending outwardly from the outboard side 30, and one or more brackets 36, such as first and second brackets 36*a*, 36*b*, extending outwardly from the inboard side 32 and arranged to be mounted in a diagonally offset pair of the receiving apertures 26. Preferably, the brackets 36 and the receiving apertures 26 are arranged such that the product hangers 14 may be releasably mounted to the hanger support member 12 to allow easy removal and re-arrangement when desired. The brackets 36*a*, 36*b* and the receiving apertures 26*a*-*d* are arranged such that the first product hanger 14*a* may be releasably mounted to the first side 18 of the web 16 with its brackets 36*a*, 36*b* disposed through a first set 26*a*, 26*c* of the receiving apertures 26, and the second product hanger 14*b* may be releasably mounted to the second side 20 of the web 16 aligned directly opposite the first product hanger 14*a* with its brackets 36*a*, 36*b* disposed through a second set 26*b*, 26*d* of the receiving apertures 26. So configured, and as shown in FIG. 1A, a distal end 38 of each bracket 36 is disposed in a space 40 between the web 16 and the body 28 of the opposite product hanger 14.

Turning again to the hanger support member 12, the web 16 has a top end 42, a bottom end 44, and left lateral and right lateral edges 46, 48 extending between the top end 42 and the bottom end 44. Each spacer flange 22, 24 forms a spacer on the first side 18 and a spacer on the second side 20. Each spacer flange 22, 24 projects in a first direction away from the first side 18 and projects in a second direction opposite the first direction extending away from the second side 20. The first spacer flange 22 is disposed along the left lateral edge 46. The second spacer flange 24 is disposed along the right lateral edge 48. Each spacer flange 22, 24 extends vertically along the respective lateral edges 46, 48. Each spacer flange 22, 24 extends from the top end 42 to the bottom end 44. The spacer flanges 22, 24 are parallel with each other and perpendicular to the web 16. The web 16 and the spacer flanges 22, 24 form an I-section extending from the top end 42 to the bottom end 44, thereby defining a recess or cavity that forms the space 40 on each of the first and second sides 18, 20 of the web 16. Said another way, the web 16 and the spacer flanges 22, 24 have an I-beam type construction with a cross-section that is shaped like the letter "I".

Each receiving aperture 26 extends completely through the web 16 from the first side 18 to the second side 20, preferably forming a tubular opening through the web 16. Each receiving aperture 26 has an upper section 50 and a lower section 52. The upper section 50 has a first horizontal width, and the lower section 52 has a second horizontal width that is less than the first horizontal width. The upper section 50 is in the form of a horizontal slot. The lower section 52 is in the form of a vertical slot extending downwardly from the upper section 50. Together, the upper section 50 and lower section 52 form a generally T-shaped opening through the web 16.

The receiving apertures 26 are arranged in a plurality of quadrilateral arrays, as shown by the dashed line 54 in FIG. 1, spaced apart vertically along the web 16. Each quadrilateral array 54 is defined by four spaced part receiving apertures, such as the receiving apertures 26*a*-26*d*, arranged in a rectangular pattern, such as a square, having one receiving aperture 26 located at each corner of the rectangle. A top pair of the receiving apertures, such as the receiving apertures 26*a* and 26*b*, defines a first horizontal row 56, such as upper row 56*a*, and a lower pair of the receiving apertures, such as the receiving apertures 26*c* and 26*d*, defines a second horizontal row 56, such as lower row 56*b*. Although the depicted embodiment shows the quadrilateral array 54 as a rectangular array, the quadrilateral array 54 may alternatively take other shapes, including a trapezoidal shape, for example, with the receiving apertures 26*a*, 26*b* being horizontally spaced apart wider than the receiving apertures 26*c*, 26*d*. Preferably, the quadrilateral array 54 is symmetrical about some vertical line, such as the longitudinal axis of the hanger support member 12. The upper row 56*a* is vertically spaced from the lower row 56*b* a first distance or height, and each quadrilateral array 54 is spaced vertically from an adjacent quadrilateral array 54 a second distance. The second distance between adjacent quadrilateral arrays 54 may be the same as or different than the height of each quadrilateral array 54. In the exemplary arrangement, the hanger support member 12 is shown with two quadrilateral arrays 54 thereby defining four vertically spaced apart horizontal rows 56; however, additional rows 56 and/or arrays 54 may be provided and/or the length of the hanger support member 12 between the top end 42 and the bottom end 44 may be increased.

Turning again to the product hanger 14, the body 28 is in the form of a plate, which is preferably flat on each of the outboard and inboard sides 30, 32. The product support member 34 in this exemplary arrangement is in the form of a hook having a first end connected to the outboard side 32 and an upturned distal end spaced from the outboard side 32. However, the product support member 34 may take other forms, such as a cleat, bracket, or other support structures (not shown) arranged to support one or more pieces of merchandise. The product support member 34 may include or be in the form of a clip. In any arrangement, the product support member 34 is arranged to support one or more units of merchandise, such as packets, bags, clusters, individual items, or other units of merchandise.

Each bracket 36 includes a shaft 58 and a head 60. The shaft 58 has a first end connected to the inboard side 32 of the body 28 and extends out from the inboard side 32 toward the distal end 38. The head 60 is wider than the shaft 58 in the horizontal direction. That is, the shaft 58 has a first horizontal width, and the head 60 has a second horizontal width that is wider than the first horizontal width. The shaft 58 and the head 60 form a flat horizontal plate, wherein each of the shaft 58 and the head 60 has a horizontally aligned, planer shape that is arranged to fit into the horizontal slot of the upper section 50 in each receiving aperture 26. The head 60 is sized to fit through the upper section 50 but not through the lower section 52. Thus the horizontal width of the head 56 is approximately equal to or slightly less than the horizontal width of the upper section 50 and wider than the horizontal width of the lower section 52. The shaft 58 is sized also to fit into the lower section 52. The head 60 is disposed at the distal end 38 of the bracket 36. The head 60 is spaced apart from the inboard side 32 of the body 28 a distance equal to at least the sum of the width of the space 40 and the width of the web 16. In this arrangement, the head 60 of each bracket 36 can first slide into and through the upper section 50 of a corresponding aperture 26 from one side of the web 16. Then, the shaft 58 can slide downwardly into the lower section 52, such that the head 60 engages the other side of the web 16 and prevents the product hanger 14 from disengaging from the web 16 while the shaft 58 is disposed through the lower section 52.

Preferably, an upper end of the lower section 52 has a constricted neck, for example formed by a pair of opposing projections 61 disposed on opposite sides of the lower section 52, that is narrower than the remaining portions of the lower section 52. The projections 61 are spaced apart a width sufficient to form an interference fit with the shaft and to allow the shaft 58 to resiliently slide through the constricted neck, thereby forming a snap-fit locking arrangement for the shaft 52 to prevent the neck 58 from accidentally slipping out of the lower section 52. Optionally, the shaft 58 may have a tapered cross-section along the side edges rather than a rectangular cross-section to help guide the shaft into the constricted neck from the upper section 50 and to help the shaft 58 resiliently snap past the projections 61.

In the exemplary arrangement depicted in FIGS. 1 and 1A, the brackets 36*a* and 36*b* are spaced apart diagonally on the body 24 of each product hanger 14. The bracket 36*a* is vertically displaced or offset above the bracket 36*b*, and each of the brackets 36*a* and 36*b* are horizontally spaced apart, preferably symmetrically, on opposite sides of a vertical center line of the inboard side 32 of the product hanger 14. The brackets 36*a* and 36*b* are arranged to engage opposite diagonal receiving apertures 26*a*, 26*c* or 26*b*, 26*d* in any one of the quadrilateral arrays 54. Thus, as illustrated in FIG. 1 relative to the product hanger 14*a*, bracket 36*a* is arranged to fit into the upper left receiving aperture 26*a* and bracket 36*b* is arranged to fit into the lower right receiving aperture 26*c* in any one of the quadrilateral arrays 54 when mounted on or from the first side 18 of the web 16. Similarly, when the product hanger 14*b* is mounted on the second side 20 of the web 16, the brackets 36*a* and 36*b* fit into the opposite diagonal receiving apertures 28*b* and 28*d*, respectively, of any one of the quadrilateral arrays 54.

Optionally, some or all of the rows 56 on a web 16 are spaced apart the same height, whereby the height of each quadrilateral array 54 is equal to the distance between each adjacent pair of quadrilateral arrays. In this arrangement, the brackets 36*a*, 36*b* of any one product hanger 14 may also fit into diagonally adjacent receiving apertures in two adjacent quadrilateral arrays 54.

To releasably mount the product hanger 14 onto the hanger support member 12, the brackets 36*a* and 36*b* are inserted into respective opposite diagonal receiving apertures, such as receiving apertures 26*a*, 26*c* if mounted on the first side 18 of the web 16 or receiving apertures 26*b*, 26*d* if mounted on the second side 20 of the web 16. The inboard side 32 of the body 28 engages distal ends of the spacer flanges 22, 24, thereby forming the space 40 in the form of a gap between the inboard side 32 and the web 16. The space 40 is sized to receive the head 60 of each bracket 36 completely therein. Thus, as best seen in FIG. 1A, a first product hanger 14 can be mounted onto the first side 18 of the web 16 and a second product hanger 14 can be mounted onto the second side 20 of the web 16 directly opposite the first product hanger 14 both horizontally and vertically aligned therewith. In this arrangement, the head 60 of each bracket 36 mounted on one side of the web 16 is disposed in the space 40 on the other side of the web 16 formed between the web 16 and the body 28 of the opposite product hanger 14 on the other side of the web 16. Thus in this arrangement, two product hangers 14 can be attached directly opposite each other in vertical and horizontal alignment on opposite sides of the web 16, without requiring a second web with a space between two webs as in the prior art.

The lower hanger support member 12*b* may be hung below the upper hanger support member 12*a* to extend the vertical length of the product display system 10. The top end 42 of the lower hanger support member 12*b* may be attached to the bottom end 44 of the upper hanger support member 12*a* by any sufficient mechanism, such as a hook or clip 62. In one exemplary arrangement, the lower hanger support member 12*b* can be hung from the upper hanger support member 12*a* by one or two product hangers 14*a* and/or 14*b*. For example, the upper bracket 36*a* of the product hanger 14*a* can be inserted into a lower or bottom receiving aperture 26 at the bottom end 44 of the upper hanger support member 12*a*, and the lower bracket 36*b* is inserted into a diagonally opposite upper or a top receiving aperture 26 at the top end 42 of the lower hanger support member 12*b*. Optionally, the second product hanger 14*b* may be mounted onto the opposite sides of the webs 16 of the upper and lower hanger support members 12*a*, 12*b* in a similar manner with the brackets 36*a*, 36*b* mounted through the opposite diagonal receiving apertures 26 at the bottom end 44 and top end 42 of the upper and lower hanger support members 12*a*, 12*b*, respectively.

Each product hanger 14 optionally includes a pair of guide flanges 64, 66 disposed along opposite lateral edges 68, 70, respectively, of the body 28. Each guide flange 64, 66 preferably extends from a top end of the body 28 to a bottom end of the body 28 along the respective lateral edge 68, 70. However, the guide flanges 64, 66 may take other forms consistent with the functionality described herein. The guide flanges 64, 66 are spaced apart laterally sufficient to engage the spacer flanges 30, 32, such as to be disposed along the outer surfaces of the spacer flanges 22, 24 when the brackets 36*a*, 36*b* are inserted into receiving apertures 26 as described previously herein. Preferably an inner surface of each guide flange 64, 66 slidably engages an opposing outer surface of the respective spacer flange 22, 24. In this manner the guide flanges 64, 66 may help to guide the brackets 36*a*, 36*b* into the appropriate receiving apertures 26. The guide flanges 64, 66 may provide additional lateral stability for the product hangers 14, for example, to prevent twisting of the product hangers 14 when hung on the hanger support member 12.

In some arrangements, the guide flanges 64, 66 may be offset inwardly between the spacer flanges 22, 24 rather than being spaced outwardly from the spacer flanges 22, 24. In such an arrangement, the guide flanges 64, 66 may also or alternatively serve as spacers to maintain the space 40 between the body 28 and the web 16 sufficient to receive the heads 60 of the brackets 36, as described previously.

The guide flanges 64, 66 are sized and/or arranged such that two product hangers 14 may be mounted directly opposite each other on opposite sides 18, 20 of the web 16, and the distal ends of the guide flanges 64, 66 on the opposing product hangers 14 will either fit tightly against each other or will be slightly spaced apart so as to not interfere or prevent the product hangers 14 from being secured to the web 16 as previously described. Each guide flange 64, 66 is not longer than approximately half the length of the spacer flanges 22, 24 and/or the depth of the distal end of the spacer flanges 22, 24 to the center of the web 16.

As shown in FIG. 1, a hanging assembly 72 is optionally disposed at or near the top end 22 of the web 16. The hanging assembly 72 includes one or both of a hanger receiver 74, such as an aperture extending through the web 16, and a hanger 76, such as a hook as exemplified in the drawings. Other forms of hanging assemblies 72 may be used that would be sufficient to hang the hanger support member 12 from some support member, such as a rod or bracket. A second aperture 78 may be disposed near the bottom end 44 of the web 16 and arranged to receive, for example, another hanger 76, such as a hook, carried as part of a hanging assembly 72 in the lower support member 12*b*.

FIGS. 2 and 2A show another example arrangement of the product display system 10, which is similar to the example product display system shown in FIGS. 1 and 1A. Like the previous example, the product display system 10 includes a hanger support member 12 and one or more product hangers 14, such as product hangers 14*a* and 14*b*, that can be releasably mounted on opposite sides 18, 20 of the web 16. The hanger support member 12 includes a vertically oriented web 16 extending between a top end 42 and a bottom end 44, a plurality of receiving apertures 26 extending through the web 16, and spacer flanges 22, 24 disposed along opposite lateral left and right side edges 46, 48 of the web 16. Each product hanger 14 includes a body 28 in the form of a flat plate, a product support member 34 in the form of a hook extending from an outboard side 30 of the body 28, and a pair of brackets 36*a*, 36*b* extending from an inboard side 32 of the body 28. Each product hanger 14 also includes a pair of guide flanges 64, 66 disposed along opposite lateral edges 68, 70 of the body 28 and extending in the same direction as the brackets 36. The product hanger 14 can be releasably mounted onto either or both of the first and second sides 18, 20 of the web by inserting the brackets 36*a*, 36*b* into corresponding ones of the receiving apertures 26. Further, two product hangers 14 can be releasably mounted simultaneously aligned directly opposite each other on opposite sides 18 and 20.

Unlike the product display system in FIGS. 1 and 1A, however, the receiving apertures 26 are arranged in a plurality of vertically spaced apart linear arrays, such as horizontal rows 56, wherein each row 56 includes four horizontal spaced apart receiving apertures 26*a*, 26*b*, 26*c*, 26*d*. Preferably, the receiving apertures 26*a-d* in each row 56 are spaced apart evenly and horizontally symmetric about a vertical centerline along the axis of the web 16, with first and second apertures 26*a* and 26*b* on the left side of the vertical center line and third and fourth apertures 26*c* and 26*d* disposed on the right side of the vertical center line as seen in FIG. 2. Each row 56 of apertures 34*a-d* may be vertically spaced from the adjacent rows 56 a distance equal to the horizontal distance between opposite ends of the row 56 or a different spacing.

Also different, the brackets 36*a*, 36*b* on each product hanger 14 are aligned horizontally and offset asymmetrically left or right between the guide flanges 64, 66 from a vertical center line of the body 28. The brackets 36*a* and 36*b* are arranged on the product hanger 14 to fit into and through the receiving apertures 26*b* and 26*d*, respectively, if mounted onto the first side 18 of the web, and to fit into and through receiving apertures 26*c* and 26*a*, respectively, if mounted onto the second side 20 of the web 16 as best seen in FIG. 2B. As with the exemplary arrangement of FIGS. 1 and 1A, each receiving aperture 26 has an upper section 50 and a lower section 52, wherein the upper section 50 is wider than the lower section 52. In exemplary arrangement of FIGS. 2 and 2A, each receiving aperture 26 has the shape generally of a key hole, wherein the upper section 50 has a generally circular shape with a first diameter and the lower section 52 is in the form of a vertically oriented slot extending downwardly from the upper section 50 with a width that is less than the diameter of the upper section 50. Preferably, an upper end of the lower section 52 has a constricted neck, for example formed by a pair of opposing projections 61 disposed on opposite sides of the lower section 52, that is narrower than the remaining portions of the lower section 52. The projections 61 are spaced apart a width sufficient to form an interference fit with the shaft 58 and to allow the shaft 58 to resiliently slide through the constricted neck, thereby forming a snap-fit locking arrangement for the shaft 52 to prevent the neck 58 from accidentally slipping out of the lower section 52. Thus, the head 60 of each bracket 36 can fit through the upper section 50 but not through the lower section 52, while the shaft 58 can slide down into the lower section 52 with a snap-fit locking action past the projections 61. Preferably, the head 60 is generally circular shaped having a diameter complementary to the shape just slightly less than the diameter of the upper section 50, and the shaft 58 has a generally cylindrical shape with a diameter just slightly less than the width of the lower section 38 and slightly larger than the space between the opposing projections 61.

In this arrangement, unlike the previous example arrangement, two product hangers 14 may be simultaneously mounted in alignment to the opposite sides 18, 20 of the web 16, and the brackets 36*a,b* of one product hanger 14 fit into receiving apertures 26*a*, 26*c* of a row 56 while the brackets 36*a,b* of the other product hanger 14 fit into receiving apertures 26*b*, 26*d* of the same row 56, as best seen in FIG. 2B.

The remaining portions of the example product display system 10 shown in FIGS. 2 and 2B are substantially similar in form and function as described with regard to the arrangement shown in FIGS. 1 and 1A. The reader is therefore referred to the detailed description of the same features provided previously herein.

Figure 3:
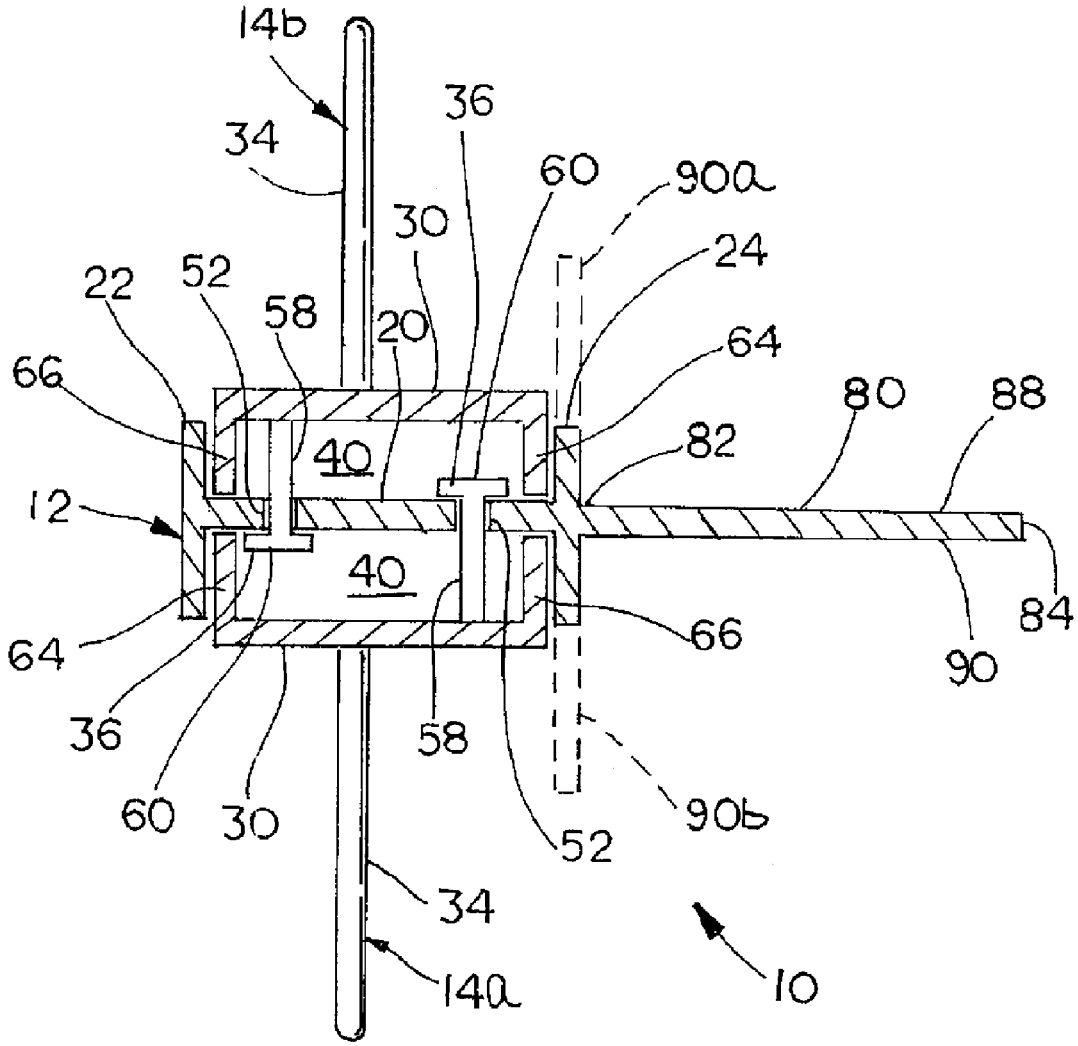
FIG. 3 is a horizontal cross-sectional view similar to FIG. 1A of another exemplary arrangement of a product display assembly according to the present disclosure.

FIG. 3 shows another exemplary arrangement of the product display system 10, wherein the guide flanges 64 and 66 on each product hanger 14 are spaced apart a distance less than the distance between the spacer flanges 22 and 24. As a result, the guide flanges 64 and 66 are disposed between the spacer flanges 22 and 24 when the product hanger 14 is mounted to the hanger support member 12. Optionally, the guide flanges 64, 66 are aligned inwardly from the spacer flanges 22, 24 and arranged to slidingly engage the inner surfaces of the spacer flanges 22, 24. In this arrangement, the guide flanges 64, 66 also function as the spacers that maintain the space 40 between the body 30 of the product hanger and the web 20 of the hanger support member 12 for receiving the heads 60 of the brackets 36.

FIG. 3 shows another optional feature for the display system 10, including one or more graphics support surfaces, such as a graphics support flange 80 extending laterally outwardly from the hanger support member 12. The graphics support flange 80 has a first end 82 connected to the exterior side of the spacer flange 24 opposite the web 20, a second, distal end 86 spaced away from the spacer flange 24, and opposite first and second sides 88, 90. The flange 80 is preferably axially aligned with the web 20. Graphics, such as printing, stickers, and/or laminates with words and/or pictures, may be carried on at least the first and/or second sides 88, 90. In some arrangements, the graphics support flange 80 has a length between the first and second ends 82, 84 of between approximately one inch (2.5 cm) and twelve inches (30 cm), although other lengths may be used depending on the anticipated use, size, and/or scale of the product display system 10 and/or graphics. Another optional graphics support surface includes one or more extensions 90 of the spacer flanges 22 and/or 24, of which only exemplary extensions 90*a* and 90*b* on spacer flange 24 are shown. Each extension 90 preferably extends beyond the body 30 when a product hanger 14 is mounted to the same side of the web 20, for example, a distance of one to twelve inches (2.5 cm-30 cm). The extensions 90*a*, 90*b* are preferably aligned with and extensions of the opposite distal ends of the flange 24. The extensions 90*a*, 90*b* may extend the entire length of the flange 24 from the top end 42 to the bottom end 44 or may be less than the entire length or be intermittent along the length of the flange 24. Like the flange 80, graphics may be carried by at least either or both sides of the extensions 90*a*, 90*b*.

Remaining numbered features of the exemplary product display system 10 shown in FIG. 3 are substantially the same in form and function as the same numbered features in the exemplary embodiments of FIGS. 1 and/or 2. The reader is therefore referred to the detailed description of the same features provided previously herein.

The product display system 10 disclosed herein may be useful for displaying products, such as merchandise, in a retail location, such as a store. In some exemplary aspects, the product display system 10 can be manufactured simply and cost-effectively by injection molding the parts from plastic and/or forming the parts from metal. The product display system is easy to assemble, and when broken down, may be very compactly stored and efficiently packed and transported.

Numerous modifications to the product display system and components thereof disclosed herein will be apparent to those skilled in the art in view of the foregoing description. Accordingly, this description is to be construed as illustrative only and is presented for the purpose of enabling those skilled in the art to make and use the product display system and to teach the best mode of carrying out same. The exclusive rights to all modifications which come within the scope of the appended claims are reserved.

I claim:

1. A product display system comprising:

a hanger support member;

a plurality of receiving apertures extending through the hanger support member along a horizontal row;

a first product hanger and a second product hanger, each product hanger comprising a first cleat and a second cleat extending from an inboard side of a body of the product hanger, the cleat each of the first and second cleats adapted to fit through one of the receiving apertures;

wherein the first and second product hangers are arranged to be mounted to opposite sides of the hanger support member aligned with each other horizontally and vertically with the first and second cleats of the first and second product hangers each extending through a separate receiving aperture along the horizontal row, a first space formed between the hanger support member and the first product hanger, the first space being sized to receive distal ends of the cleats from the second product hanger such that the distal ends of the cleats of the second product hanger are positioned closer to the inboard side of the body of the first product hanger than to the inboard side of the body of the second product hanger, a second space formed between the hanger support member and the second product hanger, the second space being sized to receive distal ends of the cleats of the first product hanger such that the distal ends of the cleats of the first product hanger are positioned closer to the inboard side of the body of the second product hanger than to the inboard side of the body of the first product hanger and, wherein each receiving aperture comprises an upper section having a first width and a lower section having a second width, wherein the second width is less than the first width, and each cleat comprises a shaft extending from the inboard side and a head spaced from the inboard side, wherein the head fits through the upper section and not through the lower section, and wherein the shaft fits through the lower section.

2. The product display system of claim 1, wherein on each of the first and second product hangers, each cleat is arranged to engage one receiving aperture when mounted to one side of the hanger support member and a different receiving aperture when mounted to the opposite side of the hanger support member.

3. A product display system comprising:

a first hanger support member comprising a web having a first side and a second side, and a plurality of receiving apertures extending through the web from the first side to the second side along a horizontal row;

a first product hanger; and a second product hanger;

each of the first and second product hangers comprising a body having an outboard side opposite an inboard side, a first bracket and a second bracket extending from the inboard side of the body and adapted to be individually mounted in one of the receiving apertures, and a product support member disposed on the outboard side;

wherein the brackets and the receiving apertures are arranged such that when the first product hanger is mounted to the first side of the web with the first and second brackets of the first product hanger disposed through respective first and second receiving apertures of the plurality of receiving apertures, and when the second product hanger is simultaneously mounted to the second side of the web with the first and second brackets of the second product hanger disposed through respective third and fourth receiving apertures of the plurality of receiving apertures, the first and second brackets of the first and second product hangers are aligned along the horizontal row, wherein distal ends of the first and second brackets of the first product hanger are disposed in a first space positioned between the web and the inboard side of the body of the second product hanger such that the distal ends of the first and second brackets of the first product hanger are positioned closer to the inboard side of the body of the second product hanger than to the inboard side of the body of the first product hanger, wherein distal ends of the third and fourth brackets of the second product hanger are disposed in a second space positioned between the web and the inboard side of the body of the first product hanger such that distal ends of the third and fourth brackets of the second product hanger are positioned closer to the inboard side of the body of the first product hanger than to the inboard side of the body of the second product hanger, and wherein each receiving aperture comprises an upper section having a first width and a lower section having a second width, wherein the second width is less than the first width, and each bracket comprises a shaft extending from the inboard side and a head spaced from the inboard side at the distal end, wherein the head fits through the upper section and not through the lower section, and wherein the shaft fits through the lower section.

4. The product display system of claim 3, further comprising:

a first spacer disposed between the first side of the web and the first product hanger, the first spacer forming a first gap between the web and the first product hanger; and a second spacer disposed between the second side of the web and the second product hanger, the second spacer forming a second gap between the web and the second hanger.

5. The product display system of claim 4, wherein the first and second spacers are carried by the web.

6. The product display system of claim 5, wherein the web and the first and second spacers form an I-section.

7. The product display system of claim 3, wherein the upper section has a diameter defining the first width and the second width is less than the diameter.

8. The product display system of claim 3, wherein the product support member comprises a hook or a clip.

9. The product display system of claim 3, further comprising a second hanger support member, wherein the receiving apertures are arranged such that the second hanger support member can be connected to the first hanger support member with the first product hanger.

10. The product display system of claim 4, wherein each of the first and second product hangers further comprises a flange extending from the inboard side.

11. The product display system of claim 10, wherein the flange engages at least one of the spacers to guide the bracket into one of the receiving apertures.

12. The product display system of claim 10, wherein the flange defines at least one of the first and second spacers.

13. A product display system, comprising:

a hanger support member comprising a web, the web having a first side, a second side, a first lateral edge, a second lateral edge, and a plurality of receiving apertures extending through the web from the first side to the second side and aligned along a horizontal row;

a first product hanger comprising a first body having an inboard side and an outboard side, a first product support member extending outwardly from the outboard side, a first bracket extending outwardly from the inboard side, and a second bracket extending outwardly from the inboard side, each of the first and second brackets further comprising a distal end spaced from the inboard side; and a second product hanger comprising a second body having an inboard side and an outboard side, a second product support member extending outwardly from the outboard side, a third bracket extending outwardly from the inboard side, and a fourth bracket extending outwardly from the inboard side, each of the third and fourth brackets further comprising a distal end spaced from the inboard side;

wherein the first product hanger is mountable to the hanger support member with the first body disposed on the first side of the web, the first and second brackets extending through respective first and second ones of the receiving apertures such that the first and second brackets are aligned in the horizontal row, and the distal ends of the first and second brackets disposed on the second side of the web;

wherein the second product hanger is mountable to the second side of the hanger support member with the second body disposed on the second side of the web, the third and fourth brackets extending through respective third and fourth ones of the receiving apertures such that the first and second brackets are aligned on the horizontal row, and the distal ends of the third and forth brackets disposed on the first side of the web, wherein when the first product hanger is mounted to the first side of the web and the second product hanger is simultaneously mounted to the second side of the web, the distal ends of the first and second brackets are positioned closer to the second body of the second product hanger than to the first body of the first product hanger and the distal ends of the third and fourth brackets are positioned closer to the first body of the first product hanger than to the second body of the second product hanger, each receiving aperture comprises an upper section having a first width and a lower section having a second width, wherein the second width is less than the first width, and each bracket comprises a shaft extending from the inboard side and a head spaced from the inboard side, wherein the head fits through the upper section and not through the lower section, and wherein the shaft fits through the lower section.

14. The product display system of claim 13, wherein the hanger support member further comprises a first spacer flange, and a second spacer flange, the first spacer flange disposed along the first lateral edge, the second spacer flange disposed along the second lateral edge.

15. The product display system of claim 14, wherein the first and second spacer flanges form a first space between the first body and the first side of the web and a second space between the second body and the second side of the web, wherein the heads of the first and second brackets are arranged to be disposed in the second space between the second side of the web and the second body of the second product hanger, and the heads of the third and fourth brackets are arranged to be disposed in the first space between the first side of the web and the first body of the first product hanger.

16. The product display system of claim 13, wherein the first, second, third, and fourth receiving apertures are arranged in a linear array.

17. The product display system of claim 3, wherein the first and second brackets of each product hanger are offset asymmetrically relative to a center line of the respective product hanger.

* * * * *

UNITED STATES PATENT AND TRADEMARK OFFICE

CERTIFICATE OF CORRECTION

PATENT NO. : 8,814,108 B2
APPLICATION NO. : 13/596748
DATED : August 26, 2014
INVENTOR(S) : David Bernstein It is certified that error appears in the above-identified patent and that said Letters Patent is hereby corrected as shown below:

In the Claims:

At Column 13, line 47, “in” should be -- on --.

At Column 14, line 7, “forth” should be -- fourth --.

Signed and Sealed this
First Day of September, 2015

Michelle K. Lee

Michelle K. Lee
*Director of the United States Patent and Trademark Office*